US012630910B2

(12) United States Patent
Jin et al.

(10) Patent No.: US 12,630,910 B2
(45) Date of Patent: May 19, 2026

(54) HIGH MANGANESE ALLOYED STEELS FOR AMINE SERVICE

(71) Applicant: ExxonMobil Technology and Engineering Company, Annandale, NJ (US)

(72) Inventors: Hyun-Woo Jin, Easton, PA (US); Weiji Huang, Katy, TX (US)

(73) Assignee: Exxon Mobil Technology and Engineering Company, Spring, TX (US)

( * ) Notice: Subject to any disclaimer, the term of this patent is extended or adjusted under 35 U.S.C. 154(b) by 358 days.

(21) Appl. No.: 18/030,198

(22) PCT Filed: Aug. 4, 2021

(86) PCT No.: PCT/US2021/071095
§ 371 (c)(1),
(2) Date: Apr. 4, 2023

(87) PCT Pub. No.: WO2022/087549
PCT Pub. Date: Apr. 28, 2022

(65) Prior Publication Data

US 2023/0374636 A1 Nov. 23, 2023

Related U.S. Application Data

(60) Provisional application No. 63/094,979, filed on Oct. 22, 2020.

(51) Int. Cl.
*C22C 38/58* (2006.01)
*C21D 8/02* (2026.01)
(Continued)

(52) U.S. Cl.
CPC ..... *C22C 38/58* (2013.01); *C21D 8/02* (2013.01); *C21D 8/021* (2013.01); *C22C 33/04* (2013.01);
(Continued)

(58) Field of Classification Search
CPC ..... C22C 38/58; C22C 33/04; C22C 38/001; C22C 38/02; C22C 38/06; C22C 38/42;
(Continued)

(56) References Cited

U.S. PATENT DOCUMENTS 7,063,752 B2 6/2006 Koo et al.
8,426,033 B2 4/2013 Ayer et al.
(Continued)

FOREIGN PATENT DOCUMENTS

EP 3026138 6/2016
EP 3202938 8/2017

OTHER PUBLICATIONS

International Search Report and Written Opinion for PCT/US2021/071095 dated Nov. 11, 2021.

*Primary Examiner* — Ricardo D Morales
(74) *Attorney, Agent, or Firm* — C. Tumey Law Group PLLC

(57) ABSTRACT

The present invention relates to ferrous alloys with high strength, cost-effective corrosion resistance and cracking resistance for refinery service environments, such as amine service under sweet or sour environments. More specifically, the present invention pertains to a type of ferrous manganese alloyed steels for high strength and cracking resistance and methods of making and using the same for applications including, but not limited to, amine units used in oil and gas production, petroleum refining, and chemical production.

14 Claims, 2 Drawing Sheets

(51) Int. Cl.

| | |
|---|---|
| ***C21D 8/021*** | (2026.01) |
| ***C22C 33/04*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |

(52) U.S. Cl.
CPC ..... *C22C 38/001* (2013.01); *C22C 38/02* (2013.01); *C22C 38/06* (2013.01); *C22C 38/42* (2013.01); *C21D 2211/001* (2013.01)

(58) Field of Classification Search
CPC ..... C22C 38/04; C22C 38/38; C21D 8/0205; C21D 8/021; C21D 2211/001; C21D 6/001; C21D 6/002; C21D 6/007; C21D 6/008; C21D 8/02; C21D 8/105; C21D 9/46; C21D 6/005
See application file for complete search history.

(56) References Cited

U.S. PATENT DOCUMENTS

| | | | | |
|---|---|---|---|---|
| 8,637,166 | B2 | 1/2014 | Ayer et al. | |
| 8,691,030 | B2 | 4/2014 | Pugh et al. | |
| 9,821,401 | B2 | 11/2017 | Fairchild et al. | |
| 10,493,569 | B2 | 12/2019 | Wasson et al. | |
| 10,493,570 | B2 | 12/2019 | Jin et al. | |
| 10,823,701 | B2 | 11/2020 | Feng et al. | |
| 10,883,965 | B2 | 1/2021 | Feng et al. | |
| 10,947,610 | B2 | 3/2021 | Verma et al. | |
| 10,974,340 | B2 | 4/2021 | Ma | |
| 11,130,204 | B2 | 9/2021 | Wasson et al. | |
| 2007/0193666 | A1 | 8/2007 | Asahi et al. | |
| 2012/0000580 | A1 | 1/2012 | Weber | |
| 2012/0160363 | A1 | 6/2012 | Jin et al. | |
| 2013/0095313 | A1 | 4/2013 | Ling et al. | |
| 2014/0261918 | A1 | 9/2014 | Jin et al. | |
| 2017/0088910 | A1 | 3/2017 | Jin et al. | |
| 2017/0306462 | A1* | 10/2017 | Kobayashi ..... | C21D 6/005 |
| 2019/0218639 | A1 | 7/2019 | Scott | |
| 2020/0063245 | A1 | 2/2020 | Verma | |

* cited by examiner

HIGH MANGANESE ALLOYED STEELS FOR AMINE SERVICE

FIELD OF THE INVENTION

This disclosure relates to ferrous alloys with high strength and good corrosion and cracking resistance for refinery and liquified natural gas (LNG) service environments, such as amine service in sweet or sour environments.

BACKGROUND OF THE INVENTION

Amine treating units are used to remove acidic gases such as hydrogen sulfide ($H_2S$) and carbon dioxide ($CO_2$) from gas or liquid hydrocarbon streams. These units are becoming increasingly important for compliance with environmental emission requirements (e.g., SOx, NOx regulations). Amine treating units can suffer corrosion caused by acid gases and impurities in the amine solution, as well as stress corrosion cracking (SCC) caused by amines or caustic, wet $H_2S$ or chlorides.

Amine units have been often been constructed of carbon steels (e.g., ASME SA516 Grade 70) or austenitic stainless steels (e.g., AISI 304L/316L). Austenitic stainless steels are often used in clad construction to avoid the risk of alkaline SCC and to achieve improved corrosion and cracking resistance in selected areas. Type 304L/316L stainless steels are low carbon grades of austenitic stainless steel having low minimum yield strengths of about 200 to 210 Mpa. Type 304L and 316L stainless steels generally have lower corrosion rates, with as little as 10% of the carbon steel corrosion rate. However, even austenitic stainless steels can suffer corrosion or cracking failures in amine units subject to severe operating conditions (e.g., high temperatures, high chloride content from formation water, or acid gas loading). Cracking of amine units can occur at areas of high residual stress caused by welding, cold forming or localized heating for hot forming. Post-weld heat treatment (PWHT) is often required to reduce the propensity for SCC of carbon steel and stainless steel equipment including piping, tanks, and vessels in amine units.

Materials are typically one of the most costly elements in typical oil and gas exploration and production. Proper selection of materials is becoming increasingly significant to project economics. Many oil and gas fields are under corrosive conditions, with $H_2S$, $CO_2$, and water present. The use of corrosion resistant alloys (CRAs) is expanding as the industry is forced to operate in harsher environments, with sourer crude oils and deeper, high pressure and high temperature wells. Carbon steels have conventionally been widely used, and are advantageous because they can be tailored in chemistry and microstructure for strength, toughness, fabricability, and weldability. In addition, carbon steels are relatively low cost structural materials. On the other hand, carbon steels having predominantly ferritic or martensitic phase do not inherently possess cracking or corrosion resistance. Carbon steels with higher strength (e.g., ≥550 Mpa yield strengths), particularly, are more susceptible to environmentally induced cracking such as SSC.

In oil, gas, and petrochemical industry Corrosion Resistant Alloys (CRA) found applications in harsh environments. One of such CRAs widely used are the austenitic stainless steels. Austenitic stainless steels provide a combination of excellent corrosion resistance, cracking resistance, oxidation resistance, and good formability and toughness. These stainless steels owe their excellent corrosion resistance to high Cr alloying, and owe their high ductility and toughness to the austenitic crystalline structure stabilized by high Ni alloying. As an example, a commonly used austenitic stainless steel, 304 stainless steel, has nominal composition of about 18 wt % Cr and 8 wt % Ni. As such, austenitic stainless steel is substantially more expensive than carbon steel, due largely to the high Ni content. Austenitic stainless steels also typically have lower strength than ferritic and martensitic carbon steels and ferritic stainless steels, and are more susceptible to SCC.

SUMMARY OF THE INVENTION

The present invention relates to ferrous alloys with high strength, cost-effective corrosion resistance, and cracking resistance. More specifically, the present invention pertains to a type of ferrous manganese-alloyed steel and methods of making and using the same for applications including amine units in oil, gas, and chemical production.

In one aspect, the present invention relates to a ferrous austenitic steel that comprises less than about 30 wt %, 20 wt %, 15 wt %, 10 wt %, 5 wt %, or 3 wt % chromium (Cr) equivalent, and at least about 7 wt %, 10 wt %, 12 wt %, 15 wt %, or 20 wt % nickel (Ni) equivalent, wherein Ni equivalent is: $Ni_{eq}=Ni+Co+0.5\cdot Mn+0.3\cdot Cu+25\cdot N+30\cdot C$;

Cr equivalent is: $Cr_{eq}=Cr+2\cdot Si+1.5\cdot Mo+5\cdot V+15.5\cdot Al+1.75\cdot Nb+1.5\cdot Ti+0.75\cdot W$; and wherein the Ni equivalent and Cr equivalent satisfy $6\cdot Ni_{eq}+Cr_{eq}\geq 15$ and $Ni_{eq}+15\geq 1.5Cr_{eq}$; and the ferrous austenitic steel comprises a predominantly austenite phase (e.g., at least 80 vol %, 90 vol %, 95 vol %, or 99 vol % austenite) and optionally one or more minor (e.g., less than 20 vol %, 10 vol %, 5 vol %, 1 vol %, or 0.2 vol %) phases of ferrite, martensite, carbide, nitride, and carbonitride. In the formulas for calculating Ni equivalent and Cr equivalent, Ni, Co, Mn, Cu, etc. refer to the amount of each respective element that is present in the steel in wt %.

In one aspect, the ferrous austenitic steel comprises at least 8 wt %, 10 wt %, 12 wt %, or 15 wt % and less than 20 wt %, 25 wt %, or 30 wt % manganese (Mn).

In one aspect, the ferrous austenitic steel has a strength level ranging from 20 ksi to 120 ksi or 205 MPa to 900 MPa.

In one aspect, the ferrous austenitic steel comprises at least 0.1, 0.3, or 0.5 wt % to less than 1.5, 1.0, or 0.8 wt % carbon, and at least 0.001 wt % to less than 1.0, 0.8, or 0.5 wt % nitrogen.

In one aspect, the ferrous austenitic steel comprises at least 0.05 wt % to less than 15 wt %, 10 wt %, 5 wt %, 1, or 0.5 wt % Al.

In one aspect, the ferrous austenitic steel comprises at least 0.05 wt % or 0.1 wt % to less than 10 wt %, 5 wt %, 1 wt %, 0.5, or 0.25 wt % Si.

In one aspect, the ferrous austenitic steel comprises less than 0.05 wt %, 0.01 wt %, or 0.001 wt % Cu.

In one aspect, the ferrous austenitic steel of the present invention comprises one or more of niobium (Nb), titanium (Ti), vanadium (V), tungsten (W), tantalum (Ta), and molybdenum (Mo), wherein the total content of these elements ranges from at least 0.01 wt % or 0.3 wt % to less than 5 wt %, 3 wt %, or 2 wt %.

In one aspect, the present invention relates to a process for manufacturing the ferrous austenitic steel disclosed herein, which comprises:

melting ferrous steel constituents to produce liquid alloy steel of inventive composition in a controlled environment wherein evaporation losses of N and Mn are controlled;

ingot or continuous casting the liquid alloy steel into mold (e.g., water-cooled cooper mold for continuous casting) to form cast ingots while suppressing Mn segregation;

reheating the cast ingots to dissolve secondary phases (e.g., carbides, nitrides, carbonitrides) at a temperature ranging from 900° C. to 1250° C.;

hot deforming at or above 600° C. to control grain size and shape of alloy steel; cooling rapidly at at least about 10° C./sec to below about 300° C.

In one aspect, the present invention relates to a process for manufacturing the ferrous austenitic steel disclosed herein, which further comprises improving the mechanical properties of the ferrous austenitic steel properties using a thermo-mechanical controlled processing.

In one aspect, the present invention relates to a petroleum refining or chemical production equipment comprising the ferrous austenitic steel disclosed herein.

Further aspects, features, and advantages of the present invention will be apparent to those of ordinary skill in the art upon examining and reading the following detailed description.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating an embodiment of the invention and are not to be construed as limiting the invention. Further objects, features, and advantages of the invention will become apparent from the following detailed description taken in conjunction with the accompanying figures.

DETAILED DESCRIPTION OF THE INVENTION

The following is a detailed description provided to aid those skilled in the art in practicing the present invention. Those of ordinary skill in the art may make modifications and variations in the embodiments described herein without departing from the spirit or scope of the present invention. All publications, patent applications, patents, figures and other references mentioned herein are expressly incorporated by reference in their entirety.

The present invention retains to a type of ferrous austenitic steels with high manganese (Mn) alloying, which provides superior sour cracking and hydrogen embrittlement resistance to carbon steels. The ferrous austenitic steels also have relatively high strengths at lower cost, and higher SCC resistance compared to conventional CRAs. The ferrous alloyed steels are predominantly austenite with minor phases that may include ferrites, martensites, intermetallic phases, carbide, nitrides, carbonitrides, borides, oxides and combinations thereof. One embodiment of the present invention includes alloyed steel with higher strength (e.g., 400 MPa or higher yield strength) facilitated by significant (e.g., not less than 0.08 wt %) interstitial alloying of carbon (C), nitrogen (N), boron (B), and combinations thereof.

As used herein, "austenite," also known as gamma-phase iron (γ-Fe), refers to a metallic, non-magnetic allotrope of iron or a solid solution of iron, with an alloying element. In plain-carbon steel, austenite exists above the critical eutectoid temperature of 1000 K (727° C.); other alloys of steel have different eutectoid temperatures.

As used herein, "austenitization" refers to heating the iron, iron-based metal, or steel to a temperature at which it changes crystal structure from ferrite to austenite. The more open structure of the austenite is then able to absorb carbon from the iron-carbides in carbon steel. An incomplete initial austenitization can leave undissolved carbides in the matrix. "Austenitic stainless steel" refers to a specific type of stainless steel alloy. Stainless steels may be classified by their crystalline structure into four main types: austenitic, ferritic, martensitic and duplex. These stainless steels possess austenite as their primary crystalline structure (face centered cubic). This austenite crystalline structure is achieved by sufficient additions of the austenite stabilizing elements nickel, manganese and nitrogen. Due to their crystalline structure austenitic steels are not hardenable by heat treatment and are essentially non-magnetic. There are two subgroups of austenitic stainless steel: 300 series stainless steels achieve their austenitic structure primarily by a nickel addition, while 200 series stainless steels substitute manganese and nitrogen for nickel, though there is still a small nickel content.

Figure 1:
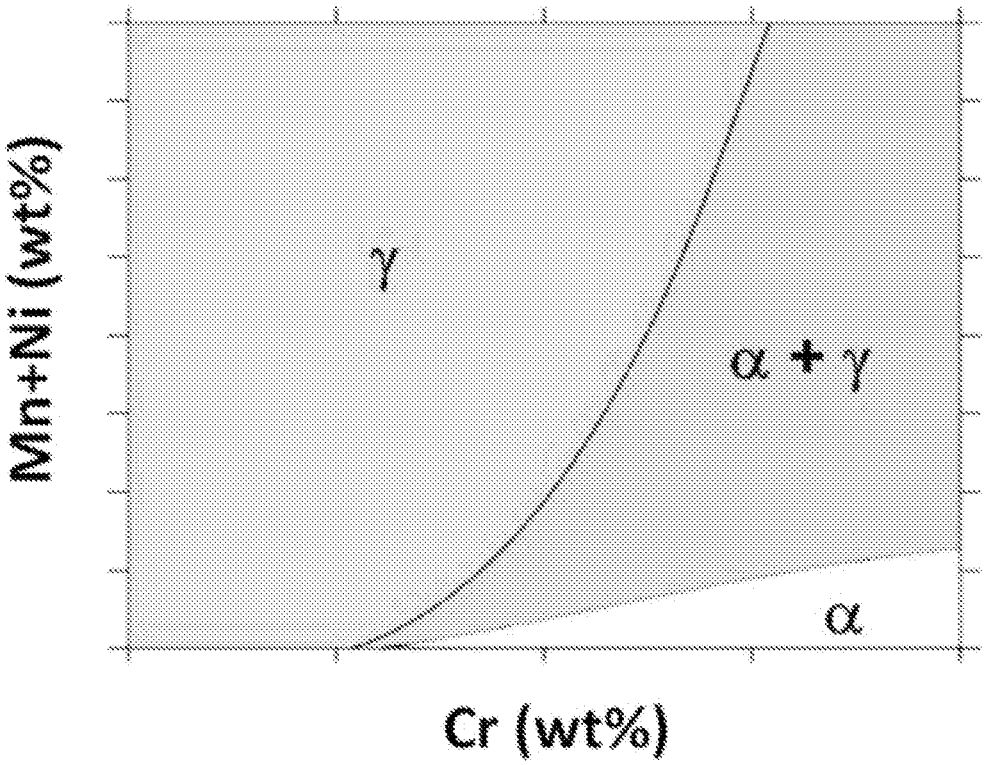
FIG. 1 illustrates a representative Fe—Cr—Mn—Ni phase diagram for ferrous austenitic steels of the present invention.

FIG. 1 illustrates a representative Fe—Cr—Mn—Ni phase diagram for ferrous austenitic steels of the present invention. Alloying of austenite stabilizing elements (e.g., Ni, Mn, Co, Cu, N, C), and ferrite stabilizing elements (e.g., Cr, Si, Mo, Al, Nb, Ti, W) can be tailored to balance the constituting phases of an alloy.

As used herein in the specification and in the claims, "nickel equivalent," or "$Ni_{eq}$" refers to calculation for the austenite stabilizing elements. Nickel equivalent has been determined with the most common austenite-stabilizing elements:

$$Ni_{eq}=Ni+Co+0.5\cdot Mn+0.3\cdot Cu+25\cdot N+30\cdot C.$$

See, R. Honeycombe, H. K. D. H. Bhadeshia, Steels Microstructure and Properties, 2nd Edition, Edward Arnold, 1995, Page 255.

As used herein in the specification and in the claims, "chromium equivalent," or "$Cr_{eq}$" refers to calculation for the ferrite stabilizing elements. Chromium equivalent has been determined empirically determined using the most common ferrite-stabilizing elements:

$$Cr_{eq}=Cr+2\cdot Si+1.5\cdot Mo+5\cdot V+15.5\cdot Al+1.75\cdot Nb+1.5\cdot Ti+0.75\cdot W \quad \text{(Equation 2)}$$

See, R. Honeycombe, H. K. D. H. Bhadeshia, Steels Microstructure and Properties, 2nd Edition, Edward Arnold, 1995, Page 254.

The steel chemistry can be tailored to use Mn+Ni along with carbon and nitrogen alloying to stabilize the austenite phase (γ-phase) and provide toughness and cracking resistance, while a limited amount of Cr alloying (not more than 15 wt %) provides suitable corrosion resistance without passivation film formation. Cr is, however, a ferrite phase (a.k.a. α-phase) stabilizer. Hence, as Cr alloying increases, addition of Mn and/or Ni alloying is required to stabilize austenite phase. FIG. 1 illustrates a representative Fe—Cr—Mn—Ni phase diagram for ferrous austenitic steels of the present invention.

In an embodiment of the present invention, the alloy chemistry satisfies at least one of the following requirements:

$6 \cdot Ni_{eq} + Cr_{eq} \geq 15$ and $Ni_{eq} + 15 \geq 1.5 \cdot Cr_{eq}$, $6 \cdot Ni_{eq} + Cr_{eq} \geq 50$ and $Ni_{eq} + 15 \geq 1.8 \cdot Cr_{eq}$, $6 \cdot Ni_{eq} + Cr_{eq} \geq 55$ and $Ni_{eq} + 15 \geq 2.0 \cdot Cr_{eq}$, $6 \cdot Ni_{eq} + Cr_{eq} \geq 90$ and $Ni_{eq} + 15 \geq 2.5 \cdot Cr_{eq}$.

These steels obtain their predominantly austenitic crystalline structure by replacing the more expensive Ni alloying in conventional austenitic stainless steels with the lower cost Mn. Additional strengthening may be achieved via interstitial alloying elements such as C, N, B, and combinations thereof. This reduces costs compared with CRAs (e.g., austenitic 304SS), but still achieve the austenite crystalline structure for high ductility and toughness.

In one embodiment of the present invention, these steels comprise of high carbon and nitrogen alloying wherein the carbon content ranges from 0.08 wt % to 1.5 wt %. and nitrogen content ranges from 0.001 wt % to 1.0 wt %.

In one embodiment of the invention, these steels may be alloyed with Cr in the range of 0 wt % to 30 wt %, such as from at least 5 wt %, 10 wt %, or 15 wt % to not more than 15 wt % or 30 wt %. This Cr alloying addition provides good corrosion resistance.

The nitrogen solubility in the melt and in the steels may be enhanced by manganese and other alloying elements such as V, Nb, Ti, and Cr, which also stabilize the austenite crystalline structure.

The carbon and nitrogen contents of the inventive steels are selected to provide a range of strength levels ranging from 205 MPa to 700 MPa in as-fabricated condition. The inventive steels can be cold deformed to achieve even higher yield strength, for instance in excess of 800 MPa.

In an embodiment of the invention, the inventive steels use Cr, Al, and Si alloying, or combination thereof, to promote passivation film formation for corrosion resistance, and use Mn+Ni alloying to stabilize austenite phase (γ-phase) for toughness and cracking resistance.

The inventive ferrous austenitic steels may provide lower than 0.18 mm per year corrosion rate at 15% MEA rich amine solution at 120° C. with acid gas loading of 0.35-0.7 moles of $CO_2$+$H_2S$ gas per mole of amine and 0.5 moles/mole $H_2S$.

Other embodiment of the current inventive ferrous austenitic steels may provide lower than 0.4 mm per year corrosion rate at 20% MEA rich amine solution at 120° C. with acid gas loading of 0.35-0.7 Moles of $CO_2$+$H_2S$ gas per Mole of amine and 0.5 Moles/Mole $H_2S$.

Other embodiment of the current inventive ferrous austenitic steels may provide lower than 1.2 mm per year corrosion rate at 30% MEA rich amine solution at 125° C. with acid gas loading of 0.35-0.7 moles of $CO_2$+$H_2S$ gas per mole of amine and 0.5 moles/mole $H_2S$.

The high manganese alloyed steels of the present invention are cost-effective materials for sweet and sour service environments. Oil, gas, and petrochemical equipment such as reactor vessels, pipes, casings, packers, couplings, sucker rods, seals, wires, cables, bottom hole assemblies, tubing, valves, compressors, pumps, bearings, extruder barrels, molding dies, and combinations thereof may be made using these steels.

Amine Acid Gas Removal Units

Amine acid gas removal units are widely utilized in upstream oil and gas applications (e.g., gas treatment in LNG plants) and in refineries (e.g., sulfur recovery units) for removing sour gas (e.g., $CO_2$, $H_2S$, HCN, thiol, and combinations thereof) from hydrocarbon streams. This is because the remnant acid gas may cause problems in hydrate formation, and affect specifications of products (e.g., ethylene in gas cracking units). The corrosion and cracking susceptibility of the construction materials render challenges in the operation of amine units, and hence the need for new material solutions.

In LNG plants, amine solvents are used to remove acid gas ($CO_2$) from the incoming process feed stream. The acid gas removal process utilizes amine absorption and regeneration to remove $H_2S$ and $CO_2$ from the feed hydrocarbon stream. Amine solutions remove sour gas by acting as a base and taking hydrogen ion from the acid gas that is formed by the dissociation of acid gas in the amine solution.

The acid gas removal by amine solutions can be represented in the following general equations $$H_2S + R_2NH \leftrightarrow R_2NH_2^+ + HS^- \quad \text{(Equation 1)}$$

$$CO_2 + R_2NH \leftrightarrow R_2NH_2^+ + R_2NCOO^- \quad \text{(Equation 2)}$$

The amine acid gas removal system is comprised of four basic parts: contact (absorber) tower, regeneration column, heat exchanger units, and reclaimer and filter.

Figure 2:
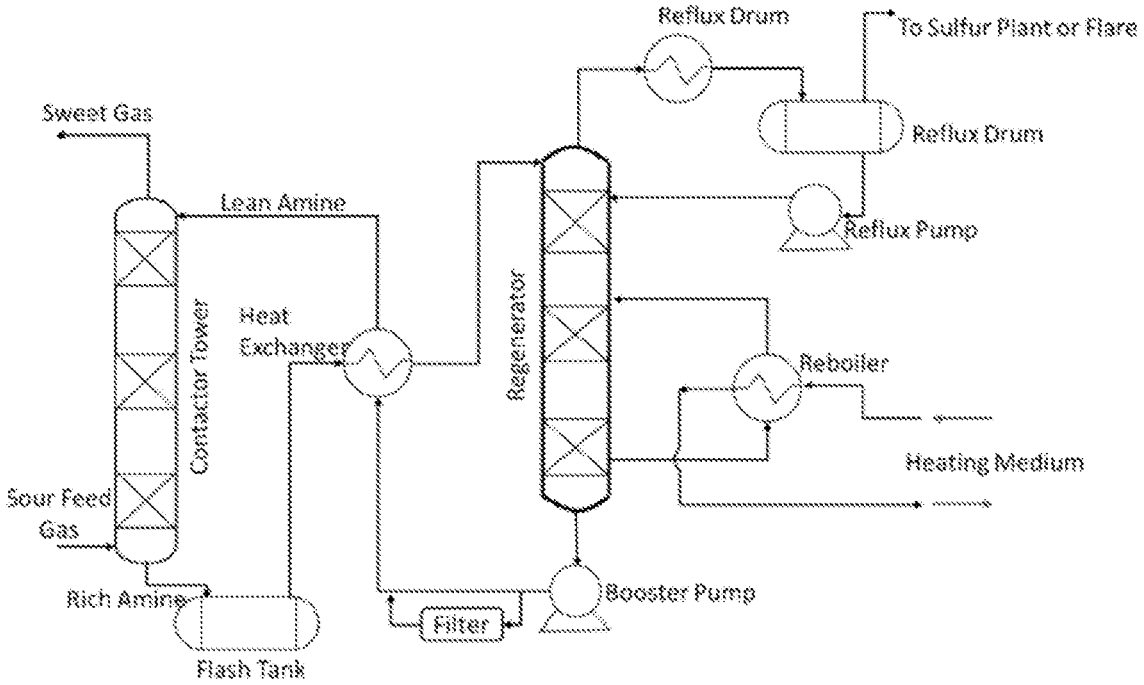
FIG. 2 illustrates a representative flow diagram of a typical amine treating unit.

FIG. 2 shows a basic flow diagram of the amine unit. A hydrocarbon stream with varied amount of acid gas is fed into an absorber below the bottom tray. The feed gas rises against a lean amine. After acid gas is removed, the treated sweet gas exits the top of the absorber tower. The temperature of the feed gas is generally low (typically less than 16° C.) while the exit temperature out of the absorber tower is upwards of 40° C. The lean amine that enters the absorber tower is upwards of 40° C., and the rich amine, which exits the bottom of the absorber column, may have temperatures upwards of 50° C. The rich amine is typically flashed off in a knock out drum before going through a heat exchanger or a series of heat exchangers. At the heat exchanger(s), the rich amine is heated up to approximately 90° C. Lean amine exits the bottom of the regenerator column at a temperature greater than 100° C. before it is cooled in the heat exchangers down to 50° C. before entering the absorber column. At the regenerator column, the rich amine enters towards the top of the column. The rich solvent flows down the column where the acid gas is removed by the rising stream.

Amine units have corrosion and cracking challenges. While it is generally understood that pure amines by themselves are not corrosive, the presence of acid gases like $H_2S$ and $CO_2$, which are stripped out of the feed gas, may cause corrosion. Environmentally assisted cracking (EAC) and general corrosion are the potential degradation mechanisms. Amine solutions can cause pitting and SCC in carbon steels. These corrosion cracks and failures may manifest in one or a combination of modes.

Acid gases dissolved in amine solutions cause general and pitting corrosion of carbon steel in both the rich and lean circuits of amine treating units. Fresh amines are alkaline and non-corrosive, but their solutions become less basic (promoting higher corrosion rates) when loaded with acid gas and heated. Acid gas corrosion is exacerbated by increased acid gas loading, temperature and velocity and by decreased pressure that leads to direct attack by acid gas break-out (flashing). Corrosion is likely to be more severe in amine systems handling only Carbon Dioxide ($CO_2$).

Sulfide Stress Corrosion (SSC)

Atomic hydrogen diffusion in carbon steel, increases the hardness of steel and embrittles it. The weld and heat affected zone (HAZ) are more susceptible to SSC.

Hydrogen Induced Cracking (HIC), Hydrogen Blistering

Hydrogen blistering is one of the forms that is covered under hydrogen induced cracking (HIC). In this process, hydrogen atoms enter the steel and accumulate at voids within the steel. Successive blisters join by internal cracking and ultimately lead to material failure. Cleanliness of steel production methods, where in the inclusion type and size is strictly controlled, is the primary way to reduce possibility of HIC.

Stress Oriented Hydrogen Induced Cracking (SOHIC)

Stress oriented hydrogen induced cracking, as the name suggests, is another form of HIC. It usually occurs in the parent metals opposed to the weld metal or HAZ. However it can occur anywhere adjacent to the HAZ or any location in the metal where stresses are concentrated.

Alkaline Stress Corrosion Cracking (ASCC)

ASCC is a corrosion mode in an alkaline environment, in the presence of $H_2S$ and $CO_2$. Higher tensile stress in the material contributes to manifest the failure through cracking. The cracks are branched and intergranular. The crack occurrence is sensitive to temperature, often associated with higher temperature ranges. Corrosion occurs in lean amine treating solutions that have $H_2S$ and $CO_2$ and the pH of the solution is between 8 and 11. The corrosion occurs when the protective film ruptures due to stress and iron is dissolved from local anodic points.

For stainless steel, lower grades of steels are more susceptible to caustic SCC, in highly caustic environments at temperatures above 120° C. Welds in non-stabilized stainless steels like Type 304 and 316 are more susceptible to intergranular corrosion (IGC), due to sensitization during welding.

Factors that influence corrosiveness include the type of amine, solution strength acid gas composition, acid gas loading, temperature, velocity, organic acids and the presence of heat-stable salts (HSAS). Oxygen contamination of the amine during storage and processing can lead to the formation of organic acids such as formic acid or acetic acid. An enhanced corrosion allowance (3 millimeter as a minimum for carbon steel) and velocity restrictions have been employed to mitigate general corrosion of carbon steel due to amines. Normally the liquid velocity is limited to less than 2 meters per second for carbon steel in lean amine service. 300 series SS with a 0.4 mm Corrosion Allowance (CA) may be employed for piping in rich amine service. The fluid velocity limit for 300 series SS is 4 meters per second.

Post weld heat treatment (PWHT) is usually required for amine services, in which the amine concentration exceeds 2 wt %, to avoid stress corrosion cracking. Exceptions are equipment and piping in uncontaminated (i.e., fresh) amine service, in which SCC does not occur.

Selection of construction materials for amine systems may vary depending on service environments (e.g., $H_2S$ concentration). Carbon steel is commonly used for systems in which the acid gas is composed of at least 5 wt % of $H_2S$. This is because the iron sulfide scale formed on the surface of carbon steel renders protection against $CO_2$ corrosion. For systems used to remove $CO_2$ and less than 5 wt % $H_2S$, stainless steels (e.g., 304 SS) are required.

In refinery service, carbon steel is the main construction material for the lean amine piping, absorber, regenerator, and reboiler vessels. Austenitic stainless steels (e.g., 304/304L and 316/316L) are typically used for higher temperature equipment such as reboiler tubes, hot rich amine piping, heat exchangers, and regenerator overheads.

Cladding is often a viable option for the construction of components for amine units due to the turbulence-induced erosion, especially for nozzles and shell internal surface. The shell internals of the vessel and nozzles are often made out of carbon steel that is lined, e.g., metallurgical bond clad stainless steel of type 304 or type 316. Type 316 is preferred over type 304 as the PREN (Pitting Resistance Equivalent Number) of 316 steel is higher than that of 304 steel due to higher alloying of Cr and Mo, and thus it can provide better performance under chlorides and naphthenic acid attacks.

The exposure to the high chlorides environment (≥1,000 ppm), will require even higher-alloyed materials such as alloy 825 or UNS S 31254 (254SMO).

The regeneration columns are constructed out of clad carbon steel. The cladding is done with ferritic stainless steel like Type 405 (UNS S 40500) steel, or Type 410, Type 420, or martensitic steel grade 440.

In reboiler tubes, Monel metal (Cu—Ni solid solution alloy) tubes (UNS N04400) are often used in environments that have $CO_2$. If $CO_2$ is not present in the system, austenitic steel type 304 or 316 is used.

The pump impellers of high silicon cast iron are often used in a low pressure amine service. Normal cast iron is also used however its performance is not as impressive and cost effective as that of high silicon cast iron impellers.

One aspect of the present invention is to make equipment in part or in entirety out of the current inventive ferrous austenitic steels, and the use of the equipment for refinery service environments, such as amine service under sweet and sour environments.

Manufacturing Processing

The current invention further includes processes for manufacturing the inventive ferrous austenitic steels comprising the following:

- Melting ferrous steel constituents to produce liquid alloy steel of inventive composition in an environment wherein evaporation losses of N, and Mn are controlled;
- Ingot or continuous casting the liquid alloy steel into mold (e.g., water-cooled cooper mold for continuous casting) to form while suppressing Mn segregation;
- Reheating the cast ingots to dissolve secondary phases (e.g., carbides, nitrides, carbonitrides) at temperature ranges from 900° C. to 1250° C.
- Hot deforming at or above 600° C. to control grain size and shape of alloy steel in to bars, sheet, plate, tubes.
- Cooling rapidly at at least about 10° C./sec to a suitable cooling stop temperature, typically below about 300° C. or to a room temperature, to form predominantly austenitic structure The processes can also include a reheating treatment at or above 150° C.

The inventive steels can be manufactured by various processing techniques including, but not limited to, thermomechanical controlled processing (TMCP). TMCP has been applied widely to produce high strength, low alloy steel plates where grain size and microstructure refinement is required to achieve enhanced mechanical properties at lower level of alloying. Hot deformation may be applied at or above the recrystallization temperature.

The inventive steels can be strengthened by second phase particles to further improve mechanical strength. The present invention is described primarily with respect to carbide/nitride/carbonitride, but applies to and includes other precipitates such as borides, oxides, intermetallics.

Carbide in general increases the hardness of materials. The size and spatial distribution of carbide are important. A considerable body of evidence has been accumulated to show that hard second phase particles contributes to increase in strength since it blocks the dislocation migration during deformation. It have been demonstrated that fine and uniformly distributed carbide is effective on materials strengthening. The coarse carbide particle is largely responsible to the mechanical failure of steels.

Carbides may enhance transformation-induced plasticity (TRIP) and twinning-induced plasticity (TWIP) to further improve the tensile strength and elongation of the inventive steels. The carbon concentration in the carbide phase is much higher than average value of the steel. By mass conservation, carbide largely depletes the carbon in its surrounding matrix. Therefore, TRIP and TWIP could be the predominant deformation mechanisms in the carbon depletion zone near carbide precipitates. Compared to the fully austenitic steel with same chemistry, the present invention has higher yield strength and work hardening capability.

To produce fine carbide particles, the carbide should be in a dissolved state before the deformation, as any undissolved carbides will suffer relatively rapid coarsening at elevated temperatures. The controlled deformation may take place below the recrystallization stop temperature so that deformation results in elongated austenite grains filled with intragranular crystalline defects, which will be the preferred nucleation sites for carbides. A slow cooling or isothermal holding is then required to promote the carbide precipitation. Finally, a rapid quench is applied to keep a fully austenitic matrix. The TMCP method has a synergistic effect of microalloy additions. Depending on the alloying elements, proper thermomechanical conditions should be selected to produce the fine particles.

Alloying elements of the present invention have some effect on either the TMCP or the bulk property modification, or both.

Carbon is the most effective alloy element to control the bulk deformation mechanism, promote carbide precipitation, and stabilize austenite phase during cooling.

Manganese is the austenite phase stabilizer. This element is mainly added to maintain a fully austenitic matrix during cooling and TMCP. It has little effect on the deformation mechanism.

Chromium is a carbide former and ferrite phase stabilizer. It will promote different types of carbide, such as $M_3C$ and $M_{23}C_6$, depending on the alloy level and thermal treatment temperature. Chromium addition is important for corrosion resistance enhancement.

Niobium (Nb), Vanadium (V), Titanium (Ti), Molybdenum (Mo) and combinations thereof are effective alloying elements to retard the recrystallization during TMCP by forming strain-induced carbonitride (e.g., (Ti, Nb) (C,N)) precipitation on the deformed austenite. In addition, these alloying elements addition help bulk carbon concentration modification in the present invention.

Aluminum and silicon may be added to tune the stacking fault energy (SFE) of high manganese steel.

Ultra-fine grained (≤20 μm or ≤10 μm grain size) high Mn steels can be fabricated by a thermo-mechanical process consisting of heavy plastic deformation at ambient, cryogenic (e.g., liquid nitrogen temperature), or intermediate temperature (e.g., 150° C. to 600° C.) to induce martensite (e.g., α'-martensite and/or ε-martensite) formation and subsequent annealing at elevated temperatures to reverse deformation induced martensite into ultrafine grained austenite.

Metastable austenite phase will be transformed to a strain-induced martensite phase by heavy plastic deformation at ambient or intermediate temperatures. The strain induced martensite should be further heavily deformed to destroy lath structure prior to reversion treatment. The strain-induced martensite shall be reverted to austenite at temperatures low enough to suppress the grain coarsening of the reverted austenite. The chemistry of high Mn steels can be tailored so that the martensite start temperature (Ms), or MD temperature of reverted austenite shall be below room temperature.

EXAMPLES

Example 1

Steel plates having the nominal chemistry shown in Table 1 were fabricated by vacuum induction melting and hot rolling. Steel plates with 25 mm thickness were fabricated by finish rolling at around 850° C. followed by accelerated cooling to room temperature.

TABLE 1

Chemistry of steels (weight percent) and mechanical properties.

| Sample ID | C (%) | Mn (%) | Cr (%) | Si (%) | Cu (%) | YS (MPa) | UTS (MPa) | El. (%) |
|---|---|---|---|---|---|---|---|---|
| Steel 1 | 0.6 | 18 | — | 0.14 | — | 433 | 1089 | 66 |
| Steel 2 | 0.8 | 18 | — | 0.1 | — | 447 | 1150 | 68 |
| Steel 3 | 0.6 | 18 | — | 0.1 | 0.5 | 453 | 1049 | 50 |
| Steel 4 | 0.6 | 18 | — | 0.1 | 2.0 | 475 | 970 | 57 |
| Steel 5 | 0.6 | 18 | 3.0 | 0.1 | — | 574 | 1089 | 51 |
| Steel 6 | 0.6 | 18 | — | 1.0 | — | 463 | 1115 | 62 |

YS: Yield strength,
UTS: Ultimate Tensile Strength,
El.: Elongation

Example 2

Steel plates having the chemistry shown in Table 2 were fabricated by vacuum induction melting and hot rolling. Steel plates with 15-25 mm thickness were fabricated by finish rolling at around 800-850° C., followed by accelerated cooling to room temperature. The liquid alloyed steel was poured into water-cooled Cu (Copper) mold to form ingots. The cast ingots were then reheated at 1200-1250° C. for 2 hours and hot deformed at temperatures at or above 600° C. to control grain size and shape of alloy steel into plates followed by rapid cooling by water quenching. Predominantly austenitic structure was achieved with minor secondary phases

TABLE 2

Chemistry of steels (weight percent) and mechanical properties.

| Sample | Chemical composition (wt %) | | | | | | | | | | YS | UTS | El. |
|---|---|---|---|---|---|---|---|---|---|---|---|---|---|
| ID | C | Mn | Cr | Si | Mo | Ti | Nb | Cu | V | N | (MPa) | (MPa) | (%) |
| Steel 7 | 0.61 | 17.5 | 3.1 | 0.15 | — | — | — | 0.5 | — | 0.001 | 597 | 1085 | 57 |
| Steel 8 | 0.60 | 18.3 | 3.0 | 0.13 | — | — | 0.02 | 0.5 | — | 0.001 | 611 | 1077 | 55 |
| Steel 9 | 0.61 | 18.0 | 3.0 | 0.14 | — | 0.021 | 0.02 | 0.5 | — | 0.014 | 618 | 1086 | 61 |
| Steel 10 | 0.62 | 18.1 | 3.0 | 0.15 | — | 0.017 | 0.02 | 0.5 | — | 0.021 | 630 | 1090 | 55 |
| Steel 11 | 0.60 | 18.2 | 3.0 | 0.12 | — | — | 0.02 | 0.5 | 0.1 | 0.001 | 625 | 1081 | 54 |
| Steel 12 | 0.59 | 18.0 | 3.0 | 0.16 | 0.52 | 0.52 | 0.02 | 0.5 | — | 0.001 | 624 | 1095 | 54 |

YS: Yield strength,
UTS: Ultimate Tensile Strength,
El.: Elongation

Example 3

SCC testing was done on an inventive steel with nominal chemistry of 0.6 wt % C-18 wt % Mn-0.07 wt % Si-0.15 wt % Al-0.002 wt % N. In order to evaluate the SCC resistance under amine solution, a slow strain rate test was carried out at the strain rate of $1.0\times10^{-6}$ under 20% MEA (monoethanolamine) aqueous solution at temperature of 70° C., and at minus (−) 0.5V potential versus SSE (saturated sulfate electrode). The 20% MEA test solution was saturated with $CO_2$ by bubbling the $CO_2$ throughout the testing. A slow strain rate test was carried out, and the inventive steel showed 36% elongation under 20% MEA solution, which is about 82% of the elongation in air, 44%, at the same strain rate.

What is claimed is:

1. A ferrous austenitic steel comprising less than 30 wt % chromium (Cr) equivalent and more than 7 wt % nickel (Ni) equivalent, wherein:

Ni equivalent is: $Ni_{eq}=Ni+Co+0.5*Mn+0.3*Cu+25*N+30*C$;

Cr equivalent is: $Cr_{eq}=Cr+2*Si+1.5*Mo+5*V+15.5*Al+1.75*Nb+1.5*Ti+0.75*W$; and Wherein the Ni equivalent and Cr equivalent satisfies $6*Ni_{eq}+Cr_{eq}\geq15$, and $Ni_{eq}+15\geq1.5*Cr_{eq}$; and the ferrous austenitic steel comprising a predominantly austenite phase and a minor phase comprising nitride, wherein nitride comprises inorganic nitride in an amount of at least 0.1 wt %.

2. The ferrous austenitic steel of claim 1, further comprising 18 wt % to 30 wt % manganese (Mn).

3. The ferrous austenitic steel of claim 1, wherein the ferrous austenitic steel has a strength level ranging from 205 MPa to 900 MPa.

4. The ferrous austenitic steel of claim 1, further comprising less than 0.001 wt % copper (Cu).

5. The ferrous austenitic steel of claim 1, further comprising 0.1 wt % to 1.5 wt % carbon and 0.001 wt % to 1.5 wt % nitrogen.

6. The ferrous austenitic steel of claim 1, further comprising 0.05 wt % to 15 wt % Al.

7. The ferrous austenitic steel of claim 1, further comprising 0.05 wt % to 10 wt % Si.

8. The ferrous austenitic steel of claim 1, further comprising one or more of niobium (Nb), titanium (Ti), vanadium (V), tungsten (W), tantalum (Ta), and molybdenum (Mo), wherein the total content of these elements ranges from 0.01 wt % to 5 wt %.

9. The ferrous austenitic steel of claim 1, further comprising 0.1 wt % to 1.5 wt % carbon and 0.1 wt % to 1.5 wt % nitrogen, 0.05 wt % to 10 wt % Al, 0.1 wt % to 3 wt % Si, and 0.01 wt % to 5 wt % of one or more of niobium (Nb), titanium (Ti), vanadium (V), tantalum (Ta), and molybdenum (Mo).

10. The ferrous austenitic steel of claim 1, further comprising less than 15 wt % Cr equivalent.

11. The ferrous austenitic steel of claim 1, wherein the austenite phase is at least 95 vol %.

12. The ferrous austenitic steel of claim 1, wherein the minor phases are less than 5 vol %.

13. A process for manufacturing the ferrous austenitic steel according to claim 1, the process comprising:

melting ferrous steel constituents while controlling evaporation losses of N and Mn to produce a liquid alloy steel having the composition of claim 1;

ingot or continuous casting the liquid alloy steel into a mold to form cast ingots while suppressing Mn segregation;

reheating the cast ingots to dissolve secondary phases at temperature ranging from 900° C. to 1250° C.;

hot deforming at or above 600° C. to control grain size and shape of the alloy steel;

cooling rapidly at at least about 10° C./sec to below about 300° C.

14. The process for manufacturing the ferrous austenitic steel according to claim 13, further comprising improving the mechanical properties of the ferrous austenitic steel using a thermo-mechanical controlled processing.

* * * * *